United States Patent [19]

Arena et al.

[11] 4,445,781

[45] May 1, 1984

[54] POST MIX DISPENSING METHOD AND APPARATUS

[75] Inventors: Alan J. Arena, Chino; Edwin Pounder, LaCanada; Michael Pawlowski, Chino; Adrian M. Totten, El Monte, all of Calif.

[73] Assignee: Signet Scientific Co., El Monte, Calif.

[21] Appl. No.: 352,754

[22] Filed: Feb. 26, 1982

[51] Int. Cl.[3] ..... B01F 15/02

[52] U.S. Cl. ..... 366/154; 366/150; 366/178

[58] Field of Search ..... 55/204; 137/600; 210/188; 222/129, 129.1, 129.2, 129.3, 129.4; 239/405, 406; 366/150, 154, 165, 336, 340, 178

[56] References Cited

U.S. PATENT DOCUMENTS

| | | |
|---|---|---|
| 1,261,986 | 4/1918 | White . |
| 1,758,552 | 5/1930 | Allen et al. . |
| 2,493,660 | 1/1950 | Elkins . |
| 2,537,119 | 1/1951 | Bauerlein et al. . |
| 2,682,976 | 7/1954 | Melikian et al. . |
| 2,755,006 | 7/1956 | Small et al. . |
| 3,289,943 | 12/1966 | Fuerst . |
| 3,304,012 | 2/1967 | Sem . |
| 3,510,061 | 5/1970 | Peczeli . |
| 3,643,688 | 2/1972 | Meinert . |
| 3,653,548 | 4/1972 | Kotscha et al. . |
| 3,653,548 | 4/1974 | McCann . |
| 3,915,187 | 10/1975 | McCalla et al. . |
| 4,092,013 | 5/1978 | Staaf ..... 366/165 |
| 4,270,673 | 6/1981 | Rodth . |

*Primary Examiner*—Philip R. Coe
*Assistant Examiner*—Arthur D. Dahlberg
*Attorney, Agent, or Firm*—Fulwider, Patton, Rieber, Lee & Utecht

[57] ABSTRACT

A post mix dispensing system for mixing together and dispensing carbonated water and a flavored soft drink syrup, while generating substantially reduced amounts of foam. Carbonated water is injected into a special staging chamber, where it circulates turbulently at about atmospheric pressure. The water is ported from the chamber through a plurality of elongated ports, substantially under gravitational forces alone, and the ports are configured to straighten the flow of water and remove most of its kinetic energy. A nozzle deflects the water to converge upon a stream of syrup and to mix with the syrup in an unconfined region, after a substantial proportion of the gases released from the water has escaped, thereby substantially reducing the generation of foam.

17 Claims, 3 Drawing Figures

POST MIX DISPENSING METHOD AND APPARATUS

BACKGROUND OF THE INVENTION

This invention relates generally to post mix dispensing systems, and more particularly to methods and apparatus for mixing together and dispensing two liquids, one of which is charged or carbonated.

Systems of this particular type are typically used to dispense soft drinks, by mixing together a flavored syrup and carbonated water. The systems normally inject both carbonated water, typically under several atmospheres of pressure, and syrup into a mixing chamber, where turbulence of the fluid flow insures thorough mixing. The mixed soft drink is then dispensed through a suitable nozzle. A sharp reduction in the pressure of the carbonated water normally occurs when it is injected into the mixing chamber, thereby causing a portion of the gases dissolved in the water to come out of solution at that time. Unfortunately, the presence of the syrup, which ordinarily has a relatively high viscosity, traps the gases being released to form undesired bubbles or foam.

Some prior systems have been designed to reduce this undesired foaming by delaying the mixing of the carbonated water and syrup until after the two liquids have exited the nozzle. Although these systems have in general produced less foam, they have not proven to be entirely satisfactory. Many of these systems are believed to have been configured such that an insufficient proportion of the gases that have come out of solution escape from the water before it is mixed with the syrup. The syrup therefore traps much of the gas that doesn't escape, to generate an excessive amount of foam. Also, many of these systems are believed to be unduly complex, adding to their expense and making them more difficult to clean.

It should therefore be appreciated that there is still a need for a post mix dispensing method and apparatus in which two liquids, one of which is charged, are thoroughly mixed together and dispensed with even less foam being generated. The present invention fulfills this need.

SUMMARY OF THE INVENTION

The present invention is embodied in an apparatus and related method for mixing together and dispensing two liquids, one of which is charged or carbonated. The apparatus includes special means for reducing the pressure of the charged liquid such that a portion of its dissolved gases come out of solution prior to mixing with the second liquid. The apparatus further includes means for forming a prescribed stream of the second liquid and special nozzle means for directing the depressurized first liquid to mix with the second liquid in an unconfined region spaced from the apparatus. In accordance with the invention, the pressure reducing means includes means defining a staging chamber and means for injecting the charged liquid into the chamber such that it circulates in the chamber at substantially atmospheric pressure, a portion of the gases dissolved in the liquid therefore coming out of solution at that time. The circulating liquid is ported from the chamber substantially under the force of gravity alone, and this porting straightens the flow of the liquid and dissipates most of its kinetic energy. A substantial proportion of the gases released from the charged liquid therefore escapes before the two liquids mix together, and the generation of foam is reduced.

More particularly, the post mix dispensing apparatus of the invention is of particular use in a soft drink dispenser of a type that mixes together and dispenses a flavored syrup and charged or carbonated water. The staging chamber is preferably ring shaped and the carbonated water is introduced into it through a plurality of ports spaced uniformly around its outer periphery. The water circulates turbulently in the chamber, and the chamber's bottom wall is sloped downwardly toward its inner periphery to distribute the circulating water substantially evenly over the wall.

The circulating water is ported from the chamber through a plurality of ports formed in the chamber's bottom wall. The ports preferably have circular cross sections and are distributed substantially evenly across the entire wall. The longitudinal axes of the ports are generally perpendicular to the direction of the water's circulating flow, and the ports have lengths of at least about two times their diameters, so that they straighten the flow of the ported water and significantly reduce its lateral velocity.

In the preferred embodiment, the ported water forms a stream having a ring-shaped cross section that is coaxial with and encircles the syrup stream. An inwardly-facing shaping surface of the nozzle means deflects the water stream radially inwardly, to converge upon and mix with the syrup stream in a region several inches below the nozzle means. Before this mixing occurs, however, a significant amount of the gases that have come out of solution escape radially outwardly to reduce the generation of foam.

Other aspects and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENT

Figure 1:
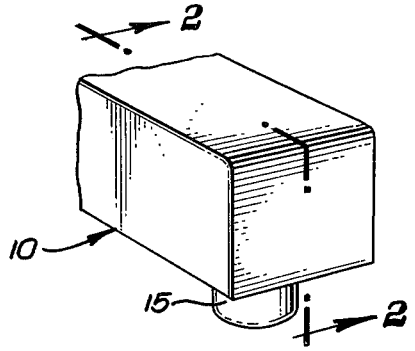
FIG. 1 is a perspective view of a post mix dispensing apparatus embodying the principles of the invention, for mixing together and dispensing carbonated water and a flavored soft drink syrup.
Figure 2:
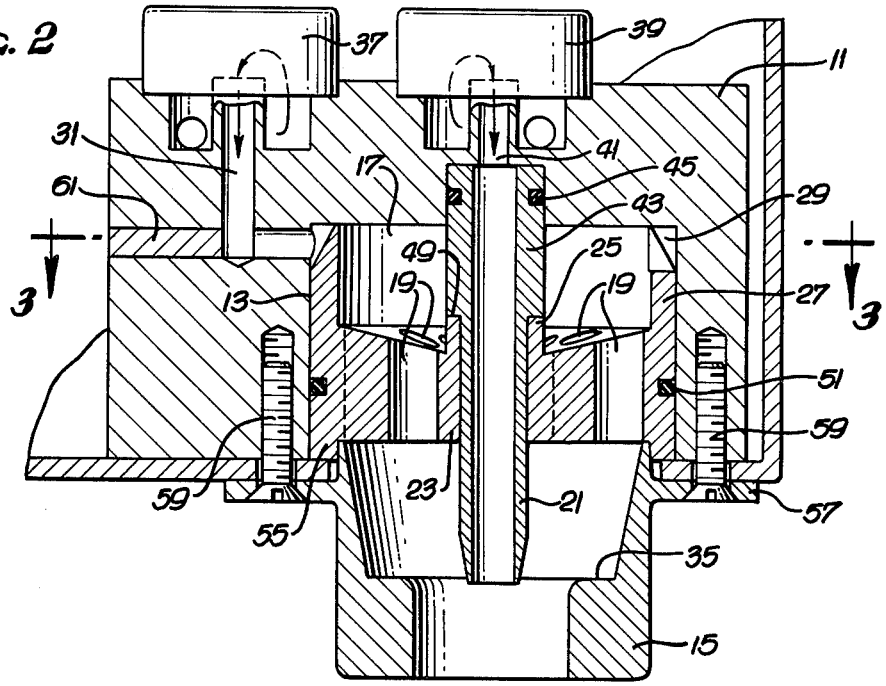
FIG. 2 is a sectional view of the post mix dispensing apparatus taken in the direction of arrows 2—2 in FIGS. 1 and 3.

Referring now to the drawings, and particularly to FIGS. 1 and 2, there is shown a post mix dispensing apparatus for mixing together and dispensing carbonated water and a flavored soft drink syrup. The apparatus includes a dispensing base or body 11, a ring-shaped diffuser 13 located in an annular recess in the body, and a nozzle 15 located below the diffuser. The diffuser and the body recess into which it fits cooperate to form a generally ring-shaped staging chamber 17 for conditioning the carbonated water in a prescribed fashion before mixing with the syrup. Water is injected into the chamber such that it circulates turbulently before being ported through a plurality of elongated ports 19 formed in the diffuser. A syrup dispensing tube 21 directs a stream of syrup through the center of the nozzle 15, and the nozzle deflects the water ported from the staging chamber 17 radially inwardly to mix with the syrup in an unconfined region spaced several inches below the nozzle.

In accordance with the invention, the diffuser 13 is specially configured such that the carbonated water swirls within the staging chamber 17 substantially at atmospheric pressure, a portion of the gases dissolved in the water therefore coming out of solution at that time. The circulating water is ported through the elongated port 19 in the diffuser substantially under the force of gravity alone. The ports are sufficiently long that they straighten the water's flow and permit a greater proportion of the released gases to escape before the water mixes with the relatively viscous syrup. The syrup is therefore not yet present to trap the released gases and create undesired foam. As a result, the apparatus dispenses soft drinks having substantially less foam than was produced by prior systems. Alternatively, it can dispense drinks significantly faster than prior systems with about the same amount of foam.

The bulk of the foam generated in dispensing the soft drink is created when the syrup and water impact together on the bottom of a drinking cup (not shown). Moreover, the foam created by that impact is minimized because the carbonated water ported from the staging chamber 17 has essentially no initial vertical velocity.

More particularly, the diffuser 13 includes a ring-shaped base 12, an upstanding cylindrical wall 25 at its inner periphery and an upstanding cylindrical wall 27 at its outer periphery. The top of the outer wall is beveled such that it cooperates with the recess in the dispenser body 11 to form an annulus 29 having a triangular cross section. Carbonated water is injected tangentially into the annulus by a water inlet conduit 31, so the water flows in a circular pattern within the annulus.

The top of the diffuser's outer wall 27 further includes four evenly-spaced slots or inlet ports 33 for porting the water circulating in the annulus 29 into the staging chamber 17. The water circulating in the annulus is ordinarily pressurized at a pressure of about two to three atmospheres, but after porting into the staging chamber, its pressure is reduced to within about one psi of atmospheric pressure.

The carbonated water swirls within the staging chamber 17 with relatively high kinetic energy, in a generally toroidal vortex. This flow pattern is created because the four inlet ports 33 are located at the top of the chamber and because the water enters with both radially inward and circumferential velocity components.

The staging chamber 17 substantially dissipates the kinetic energy of the circulating water, and the water drops through the elongated ports 19 substantially under gravitational forces alone. All of the ports have circular cross sections and have lengths at least about twice their diameters. This elongation straightens the water's flow and minimizes its turbulence, to facilitate the escape of the gases released from the water in the staging chamber.

Figure 3:
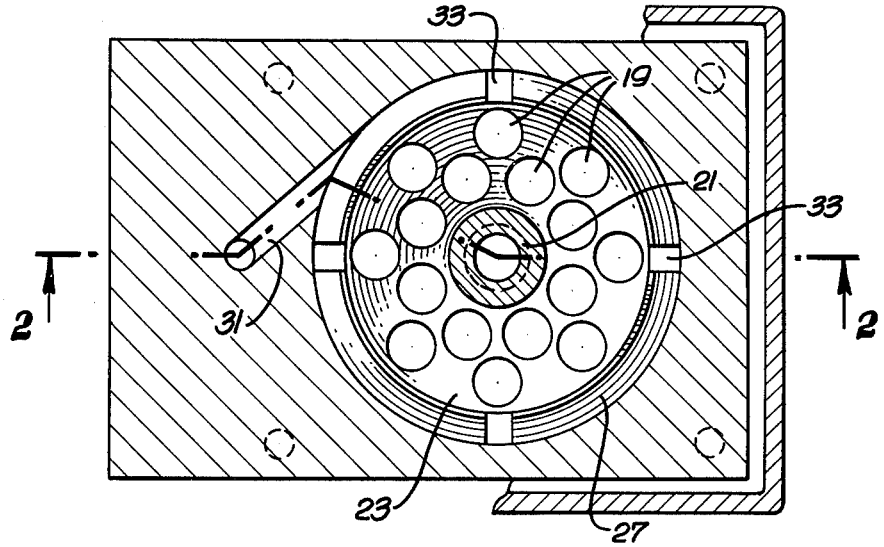
FIG. 3 is a sectional view of the post mix dispensing apparatus taken in the direction of arrows 3—3 in FIG. 2.

As shown in FIG. 3, the elongated ports 19 are arranged substantially evenly over the diffuser base 23. Eight of the ports are evenly spaced at a common radius adjacent the outer wall 27 and eight additional ports are evenly spaced at a common radius adjacent the inner wall 25. The diffuser base slopes downwardly toward the inner wall, to facilitate an even flow distribution through the 16 ports.

The water dropping through the outer ring of elongated ports 19 strikes a specially configured shaping surface 35 of the nozzle 15, which deflects the water radially inwardly to a slight degree, into the undeflected flow of water dropping through the inner ring of ports. This causes the composite flow stream to converge radially inwardly outside the nozzle.

Simultaneously, the syrup is injected through the syrup dispensing tube 21 to form a syrup stream that is encircled by the converging stream of water. The two streams first mix together at a location several inches below the nozzle 15, which provides sufficient time for a substantial proportion of the gases released from the water to escape radially outwardly. These gases therefore escape before they come into contact with the relatively viscous syrup, which otherwise could trap the gases and cause undesired foam.

The apparatus further includes a water valve 37 and a syrup valve 39 for controllably supplying the carbonated water and the flavored syrup, respectively. The valves turn on and off in accordance with control signals generated by control circuitry (not shown). Water supplied by the water valve is channeled through the water inlet conduit 31 to the annulus 29, and syrup supplied by the syrup valve is channeled through a syrup inlet conduit 41 to the syrup dispensing tube 21.

The syrup dispensing tube 21 includes a base end 43 that fits in a first cylindrical recess formed in the dispenser body 11, in alignment with the syrup inlet conduit 41. An O-ring 45 is disposed in an annular seat formed in the outer wall of the base end, to prevent syrup or water from flowing in the space between the syrup dispensing tube and the dispenser body.

The diffuser 13 fits in a second cylindrical recess formed in the dispenser body 11, surrounding the recess for the syrup dispensing tube 21. The diffuser's inner wall 25 abuts a shoulder 49 in the syrup dispensing tube 21 when the diffuser is properly positioned in the dispenser body. An O-ring 51 is disposed in an annular seat formed in the diffuser's outer wall 27 to prevent water from flowing in the space between the diffuser and the dispenser body.

The nozzle 15 fits within a ring 55 formed in the underside of the diffuser 13. The nozzle includes an annular flange 57 that abuts the underside of the dispenser body 11 and is fastened in place by a plurality of screws 59. Fastening the nozzle to the body in this fashion secures the entire assembly together.

The entire mixing chamber assembly is removable from the remainder of the dispenser 10 (FIG. 1), to facilitate cleaning. The assembly further includes a removable plug 61 that permits convenient access to the water inlet conduit 31.

It should be appreciated from the foregoing description that the present invention provides an improved post mix dispensing apparatus for mixing together and dispensing carbonated water and a flavored syrup while generating substantially reduced amounts of foam. The carbonated water is injected into a special staging chamber, where the water circulates with high kinetic energy substantially at atmospheric pressure. The circulating water is ported from the chamber through a plurality of elongated ports substantially under gravitational forces alone, and the ports are configured to straighten the flow of water and remove most of its kinetic energy. A nozzle directs the water to converge upon a separate stream of syrup and mix with it in an unconfined region, after a substantial proportion of the gases released from the water has escaped. The relatively viscous syrup is therefore not present to trap the escaping gases and generate undesired foam.

Although the invention has been described in detail with reference to the presently preferred embodiment, it should be understood by those of ordinary skill in the art that various modifications can be made without departing from the scope of the invention. Accordingly, the invention should not be limited, except by the appended claims.

I claim:

1. Post mix dispensing apparatus for dispensing a first, charged liquid and a second liquid comprising:

means defining a staging chamber;

means defining a plurality of ports spaced around the periphery of the staging chamber for injecting a first, charged liquid into the staging chamber such that the liquid circulates turbulently in the chamber at substantially atmospheric pressure, a portion of the gases dissolved in the liquid therefore coming out of solution;

wherein the means defining a staging chamber includes a bottom wall and means defining a port in the bottom wall for porting the liquid circulating in the chamber substantially under the force of gravity alone, the port straightening the flow of the liquid and dissipating most of its kinetic energy;

means for forming a stream of a second liquid; and nozzle means having an opening for discharging the stream of the second liquid and the charged liquid ported from the staging chamber, the opening having a crosssectional area substantially larger than that of the means for forming the stream of the second liquid, the nozzle means directing the charged liquid to mix with the stream of the second liquid.

2. Post mix dispensing apparatus as defined in claim 1, wherein the means defining a port further defines a plurality of ports distributed across the bottom wall.

3. Post mix dispensing apparatus as defined in claim 2, wherein the plurality of ports located in the bottom wall defining the staging chamber all have a substantially circular cross-section and are distributed substantially evenly over the bottom wall.

4. Post mix dispensing apparatus as defined in claim 2, wherein the bottom wall defining the staging chamber has a prescribed slope such that the circulating liquid is distributed substantially evenly over it.

5. Post mix dispensing apparatus as defined in claim 2, wherein each of the ports in the bottom wall defining the staging chamber has a length at least about twice its dimension in the direction in which the liquid flows immediately above it in the chamber, whereby substantially all of the kinetic energy of the circulating liquid is dissipated.

6. Post mix dispensing apparatus as defined in claim 2, wherein:

the staging chamber is substantially ring shaped and the ports produce a flow of liquid having a substantially ring-shaped cross section;

the second liquid stream formed by the means for forming is coaxial with and encircled by the first liquid stream formed by the ports; and the nozzle means directs the first liquid stream to converge inwardly toward the second liquid stream.

7. Post mix dispensing apparatus as defined in claim 1, wherein the means defining a plurality of entry ports includes a ring-shaped chamber surrounding the staging chamber and communicating with it via the plurality of entry ports.

8. Post mix dispensing apparatus for dispensing carbonated water and a flavored soft drink syrup comprising:

means defining a substantially ring-shaped staging chamber;

means defining a plurality of entry ports spaced substantially evenly around the periphery of the staging chamber, for injecting carbonated water into the chamber, the injected water circulating turbulently in the chamber at substantially atmospheric pressure such that a portion of the gases dissolved in the water comes out of solution;

wherein the means defining a staging chamber includes means defining a plurality of exit ports for porting the water circulating in the chamber substantially under the force of gravity alone, the exit ports straightening the flow of the water and substantially dissipating its kinetic energy, the ported water forming a stream having a substantially ring-shaped cross section;

syrup dispensing means for forming a syrup stream coaxial with the water stream; and nozzle means having an opening for discharging the water stream and the syrup stream, the opening having a cross-sectional area substantially larger than that of the means for forming the syrup stream, the nozzle means deflecting the water stream radially inwardly to mix with the syrup stream in an unconfined region spaced from the nozzle means, after a substantial proportion of the gases released from the carbonated water has escaped, whereby the generation of foam is reduced.

9. Post mix dispensing apparatus as defined in claim 8, wherein the means defining a staging chamber includes a bottom wall and the plurality of exit ports all have a circular cross section and are distributed substantially evenly across the bottom wall.

10. Post mix dispensing apparatus as defined in claim 9, wherein:

the entry ports are located on the outer periphery of the staging chamber; and the bottom wall is sloped downwardly toward the inner periphery of the staging chamber such that the circulating water is distributed substantially evenly over it.

11. Post mix dispensing apparatus as defined in claim 9, wherein the exit ports all have lengths at least about twice their respective diameters, to facilitate their straightening of the water flow and dissipating of its kinetic energy.

12. Post mix dispensing apparatus as defined in claim 8, wherein the means defining a plurality of entry ports includes a ring-shaped chamber surrounding the staging chamber and communicating with it via the plurality of entry ports.

13. Post mix dispensing apparatus for dispensing carbonated water and a flavored soft drink syrup comprising:

means defining a substantially ring-shaped staging chamber;

means defining a plurality of entry ports spaced substantially evenly around the outer periphery of the staging chamber, for injecting carbonated water into said chamber, the injected water circulating turbulently in the chamber at substantially atmospheric pressure such that a portion of the gases dissolved in the water comes out of solution;

wherein the means defining a staging chamber includes a bottom wall and means defining a plurality of circular exit ports distributed substantially evenly across the bottom wall, for porting the water circulating in the chamber substantially under the force of gravity alone, wherein the bottom wall is sloped downwardly toward the inner periphery of the staging chamber such that the circulating water is distributed substantially evenly over it, and wherein the exit ports all having lengths at least about twice their respective diameters, to straighten the flow of water and substantially dissipate its kinetic energy, the ported water forming a stream having a substantially ring-shaped cross section;

syrup dispensing means for forming a syrup stream coaxial with the water stream; and nozzle means having an opening for discharging the water stream and the syrup stream, the opening having a cross-sectional area substantially larger than that of the means for forming the syrup stream, the nozzle means deflecting the water stream radially inwardly to mix with the syrup stream in an unconfined region spaced from the nozzle means, after a substantial proportion of the gases released from the carbonated water has escaped, whereby the generation of foam is reduced.

14. A method for post mix dispensing a first, charged liquid and a second liquid, comprising steps of:

injecting a first, charged liquid into a staging chamber such that the liquid circulates turbulently in the chamber at substantially atmospheric pressure, a portion of the gases dissolved in the liquid therefore coming out of solution;

porting the circulating liquid from the staging chamber substantially under the force of gravity alone, the step of porting including a step of straightening the flow of the liquid and dissipating a substantial proportion of its kinetic energy;

forming a stream of a second liquid; and directing the charged liquid ported from the staging chamber to mix with the stream of the second liquid in an unconfined region, after a substantial proportion of the gases released from the first liquid has escaped, whereby the generation of foam is reduced.

15. A method as defined in claim 14, wherein:

the staging chamber is substantially cylindrical; and the step of injecting injects the charged liquid into the chamber through a plurality of entry ports spaced substantially evenly around the periphery of the chamber.

16. A method as defined in claim 14, wherein:

the step of porting produces a generally cylindrically-shaped stream of the first liquid that surrounds and is coaxial with the second liquid stream; and the step of directing deflects the cylindrically-shaped first liquid stream radially inwardly to mix with the second liquid stream.

17. A method as defined in claim 14, wherein:

the method further includes a preliminary step of injecting the first liquid into a ring-shaped chamber having a plurality of circumferentially-spaced exit ports; and the step of injecting the first liquid into the staging chamber is accomplished using the plurality of exit ports in the ring-shaped chamber.

* * * * *